US005809678A

United States Patent [19]

Douglas

[11] Patent Number: 5,809,678

[45] Date of Patent: Sep. 22, 1998

[54] DEVICES FOR ALTERATION AND DISPLAY OF CHEMILUMINESCENT LIGHT

[76] Inventor: Andre J. T. Douglas, 1046 Brookview Ave., Westlake Village, Calif. 91361

[21] Appl. No.: 708,028

[22] Filed: Aug. 30, 1996

Related U.S. Application Data

[63] Continuation-in-part of Ser. No. 382,525, Feb. 2, 1995, Pat. No. 5,557,869, which is a continuation of Ser. No. 239,834, May 9, 1994, abandoned, which is a continuation of Ser. No. 975,009, Nov. 12, 1992, abandoned, which is a continuation-in-part of Ser. No. 663,365, Feb. 27, 1991, abandoned.

[51] Int. Cl.[6] ..... G09F 13/20

[52] U.S. Cl. ..... 40/542; 40/605; 362/34; 362/812

[58] Field of Search ..... 40/542, 564; 362/34, 362/812, 103

[56] References Cited

U.S. PATENT DOCUMENTS

| | | | |
|---|---|---|---|
| 2,624,141 | 1/1953 | Martin | 40/564 |
| 4,814,949 | 3/1989 | Elliott | 362/34 |
| 5,557,869 | 9/1996 | Douglas | 40/542 |

*Primary Examiner*—Brian K. Green

[57] ABSTRACT

An artistic display device includes a shell having a substantially flat front wall through which an optical image is to be transmitted. A body of liquid-absorbing material essentially in the shape of a flat layer disposed parallel to the front wall and having a perimetrical portion that is disposed adjacent the front wall. A flat light control member disposed between the body of liquid-absorbing material and the front wall of the shell. The shell further having a rear wall disposed substantially parallel to the front wall. The walls are secured together by impervious seal. The rear wall also having a perimetrical portion positioned in supporting relationship to the perimetrical portion of the body of liquid-absorbing material. The rear wall being also rearwardly recessed inside its perimetrical portion to form at least one compartment containing a set of frangible vials having separate chemiluminescent liquids therein. The front wall peripheral edges are larger in dimension than the rear wall peripheral edges having at least one portion thereof, protruding outwardly and beyond the rear wall peripheral edges. Providing an extended space between the front wall and the rear wall peripheral edges which forms an extended flange to aid as a substructure for manipulation into independent articles for exhibition of the device.

16 Claims, 8 Drawing Sheets

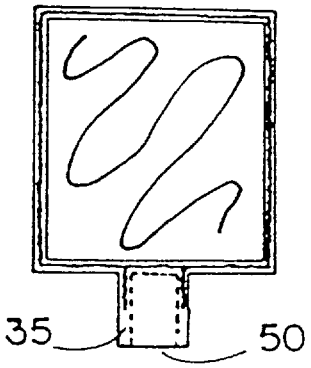
FIG. 13 A
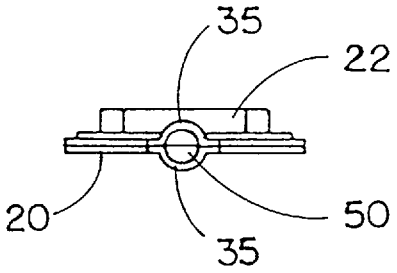
FIG. 13 B
FIG. 14
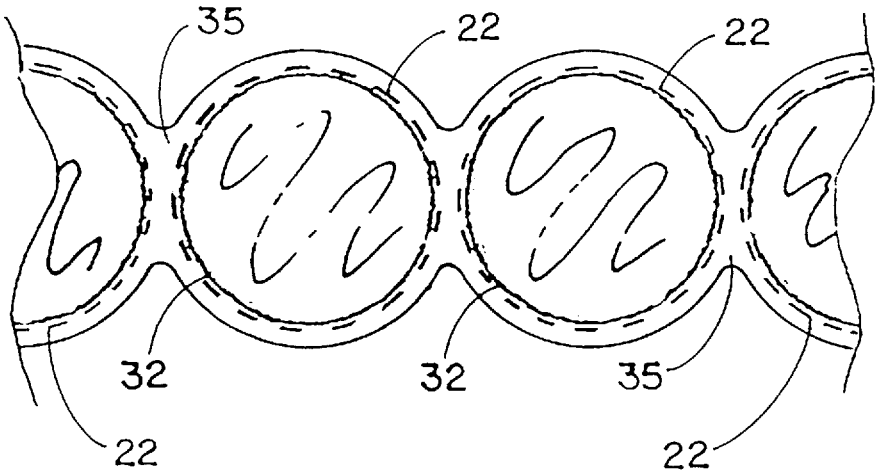

DEVICES FOR ALTERATION AND DISPLAY OF CHEMILUMINESCENT LIGHT

This application is a continuation-in-part of my prior application Ser. No. 08/382,525 filed Feb. 2, 1995, now U.S. Pat. No. 5,557,869, which was a file wrapper continuation of my prior application Ser. No. 08/239,834 filed May 9, 1994, subsequently abandoned; which was a file wrapper continuation of my prior application Ser. No. 07/975,009 filed Nov. 12, 1992, subsequently abandoned; which in turn was a continuation-in-part of my prior application Ser. No. 07/663, 365 filed Feb. 27, 1991; and subsequently abandoned.

FIELD OF INVENTION

The instant invention relates generally to chemiluminescent devices and more particularly to devices adapted to control chemiluminescent light for display, where the peripheral area beyond the liquid-tight and imperviously seal compartment has typically been unexplored as a method of not only secondary exhibition and support but more importantly, the creative use of this peripheral area produces independent articles of manufacture having further useful applications.

DESCRIPTION OF RELATED ART

Devices which employ the principles of chemiluminescent light have been commercially available for many years. These devices have typically been in the form of containers for chemiluminescent chemicals, used as novelty or emergency items such as shapes, balls, wands, etc. The chemiluminescent effect generates a high degree of attention, and therefore as a secondary function these items have had consumer advertising imprinted upon portions of their outer surface. The increase in such advertising is true, in spite of numerous drawbacks inherent when attempting to use these items to display distinctive logos, trademarks, etc.

Comparably display devices of gaseous tube or electric bulb type are commonly used as advertising mediums, which likewise render images visible in darkened areas. These too have inherent drawbacks limiting their scope of exhibition when considered for limited duration or single event advertising or novelty articles of manufacture.

Display devices and signs have been heretofore available or proposed. In many cases they are bulky, fragile, noisy, and expensive devises, therefore leaving much to be desired as a limited duration or single event display device. In point of sales advertising, it is desirable to be unique, and strongly draw attention to the projected image.

Thereafter, inventors have created several types of display devices or consequently, other inventions have been used as advertizing or novelty mediums. Electronically illuminated devices as described in U.S Pat. No. 2,298,940 to Heys (1942), and 3,978,599 to Berger (1976), both offer electronically illuminated display devices for advertizing. However both have detrimental limiting factors when considered for one-time or limited duration promotions, due to their relatively high cost to produce and operate. Including inherent restrictions limiting their dimensions to that of electrical fittings, and location to their access to electrical source, thereby, most being of a permanent nature, whose bulk requires considerable support.

U.S. Pat. No. 4,061,910 to Rosenfeld (1977), and 3,567, 987 to Myers (1971), a piece of jewelry and a wand respectively, both being containers for chemilumine scent chemicals. Both, though not initially intended, have had messages imprinted on their surfaces suffering similar drawbacks in that their surfaces restrict size and legibility, thereby, requiring close inspection to reveal their intended display.

The chemiluminescent device of U.S. Pat. No. 4,814,949 to Elliott (1989) for example, reveals a shaped container with a sealed lid creating a relatively vast cavity space, which houses chemiluminescent chemical, isolated in glass ampules, until released by crushing the ampules or vials to become mixed or activated and then saturated into an absorbent article which is the same shape as the cavity profile, in so doing the articles shape is projected as a lighted image. These teachings, like most other prior-art show the periphery of the device only useful as to seal the contents there-in and never demonstrating the potential for extending those areas to form useful structures that themselves produce independent articles of manufacture.

Among the deficiencies in Elliotts crude design, it utilizes a single uninterrupted recess forming a relatively vast cavity throughout its peripheral shape, having a totally unrestricted cavity volume far greater than the entire volume or mass, of its internal components. This practice immediately allows all internal components to freely move into any obscure areas or diagonals of the cavity. Once dislodged in this manner, the device is prone to unsatisfactory performance, such as component collapse and poor activation. This problem exists in all cases but becomes greatly accentuated when attempting larger or more complex shapes and cavities which are often desirable to provide an effective artistic display.

The consequences of this problem are numerous. the foremost being that the absorbent article, lacks any form of surface support that will at least physically restrict its movement between the forward and rearward surfaces of the cavity. And so, the absorbent is more likely to deform, buckle, dislodge, become misaligned or fall diagonally across the cavity, which destroys the quality of the intended light effect.

This performance is unavoidable due to the disproportionate ratio of cavity volume to component mass, and will always produce this failed result especially when attempting larger display dimensions.

Another consequence of this vast unrestricted cavity is that the glass ampules are able to move about freely, and so the potential for failed activation exists, because, in cases when there are more than one pair of these ampules, it is likely to miss one or two of the ampules during activation, and in such cases, a disproportionate or delayed mix will occur, which detrimentally increases the time it takes to activate, and the points of release of the chemiluminescent light for suitable presentation.

Elliott also teaches limitations, in that, the internal image or light shape projected is substantially the same shape as the outer shell itself, and should emit light uniformly across its entire surface.

This mono-tonic attitude is specified by several critical design limitations, which dictate that, the absorbent article must enhance light evenly, without variation throughout its entire surface area, and be of substantially the same shape as the outer shell .

This strict practice demonstrates that Elliotts intended device could only provide a shaped container which projects a mono-tonic light throughout its forward facing surface, without any variation in shade or color.

When considering the combined effects of these problems experienced in Elliotts teachings, it becomes apparent that Elliotts device is better suited to that of small novelties rather than attempting the complexities of larger more diverse aspects required for artistic display and novelty products.

In fact, Elliotts teachings cannot even ensure activation repeatability, from one identical device to another.

Among other limitations in this design, Elliott uses one side of the device to provide its primary and only component for purposes of display and support for device exhibition and use. This is taught to be achieved by applying a double-sided adhesive tape to a side, and once the device is activated, the second side of the tape is removed and the device as intended, is then stuck to a flat surface for display.

The downfall of this technic is that, only one side of the device can be viewed or utilized at any given time, and therefore, wasting the potential of simultaneously using the other side for a second or independent display, and there is on teaching to facilitate an alternative method of support. Furthermore, even if Elliott were to independently attach the device to another article of manufacture "after-the-fact", this would not be a prudent and economically competitive method of production due to the added steps and the concern among other things for the device becoming separated from its host.

Once again Elliotts teaching does not recognize this double-sided option, because, there is a strict requirement that the absorbent conform exactly to the inner surface of the "front" shell for best result. Therefore, not only is it impossible to achieve the same good result when simultaneously viewed from the opposite side, but, also impossible to achieve an effective double sided display.

There are many short comings in Elliotts design and others heretofore proposed when considering the many needs of an illuminated, limited duration artistic display, such as the ability to produce variations in physical size, complexity of shape, distinct detail, light contrast, multi-color display, projection control, repeatability of operation, and most importantly exhibition variation.

Accordingly, industry is continually on the lookout for chemiluminescent devices, which overcome most, if not all, of the deficiencies mentioned above, which devices provide effective replication of distinctive images often required by the consumer, and are relatively simply manufactured by the manufacturer.

SUMMARY OF INVENTION

There is disclosed herein an improved display for the systematic alteration and control of emitted chemiluminescent light, which overcomes many of the deficiencies of prior art disclosed devices, accordingly several objects and advantages of my invention are outlined as follows;

The principle object of my invention is to provide a device, having several systematic features, that may be optionally combined and applied to the design of an illuminated artistic display, it is then possible to produce a chemiluminescent device of greater physical variation, demonstrating superior display control during activation and operation.

Matters such as shape, size, shade, color, exhibition and especially interconnection, are addressed by implementing combinations of these specific features as a system, each of which complements and assists the performance of the other, and whose collective assembly accommodates the specific requirements of a unique image to be projected in a lighted form.

It is one main object to provide an outer shell that is not only multi-functional and imperviously sealed to form a container, but that the container mirrors the protruding profiles of the internal components in places, primarily to control the position of its internal components, each confined in mirrored outwardly protruding recesses or compartments designed to coincide directly with the physical profile and displacement of the respective component thus creating in essence a minimal cavity design which bolsters the internal position of the components.

One advantage of this technique, is that internal component collapse and migration is effectively kept in check, because multiple portions of the front and rear walls or shells are parallel or in close contact with the internal components, hence these internal components are supported simultaneously by the front and rear walls, thus affording greater physical diversity and choice in shape, size, and material types.

Another advantage to mirroring the protruding profiles of the internal components, is that the activation process becomes more precise, due to easily recognized outward protrusions or recessed areas within the walls which contain the necessary internal chemical components awaiting activation, thus ensuring proportionate chemical mix, especially in complex or larger shapes.

A further advantage of such minimal cavity shell design, is that strategic placement of the components within the walls, makes it possible to achieve reasonably even points of chemical release for saturation into other internal components, thus resulting in a device with repeatable and predictable activation.

Yet another advantage of such minimal cavity shell design, is that because the two part chemiluminescent chemical is released into relatively smaller confines of the outward recesses or compartments within the device, the chemical is forced to mix more thoroughly.

This multi-functional shell, is not only capable of the above mentioned active controls of its internal components, but the device also demonstrates a distinctive support or propping technique by adapting areas of the extreme periphery or flange area which may be extended further outwardly and beyond the boundary of its impervious seal, resulting in a device with potentially unlimited exhibition and support qualities.

One advantage of this extended flange function, is that this area may be utilized as a point of attachment, suspension or support, by shaping or forming the extensions upper edge to facilitate becoming merged, joined, interconnected, linked, fixed, bonded, overlapped or combined, thus creating unlimited variation of exhibition and support, with the option to form part of larger or continuous type displays.

Another advantage of this extended flange function, is that by using this area as a support or attachment area, consequently all sides become free and visually unobstructed, to then provide the option of viewing or projecting its lighted image from either side, thus creating a multi-sided display.

Another primary object of my invention, is to provide a multi spectrum type internal light control technique's for the visual enhancement or suppression of chemiluminescent chemical.

And so, in creating an artistic display device whose shell actually mirrors the outwardly protruding or parallel contours of its internal components, essentially creating a cavity of relatively minimal proportions, resulting in full control and support of those internal components, and by utilizing the full advantages of extending the flange area beyond the impervious seal, resulting in a new and unique substructure ideally suited for the accommodation of fixing and securing elements, which when manipulated and interlocked, create independently useful articles of manufacture, thus evolving into an effective display system for the control and exhibition of chemiluminescent light.

Which to this point, has to the best of my knowledge never been so diversified, thus allowing the advantageous use of a wider variety of materials and design, in turn opening new horizons for the manufacture of larger or more complex and relatively economical displays, with greater commercial appeal.

Other objects and advantages, of this invention will be obvious upon the understanding of the illustrative embodiment about to be described, or will be indicated in the appended claims, and various advantages not referred to herein will occur to one skilled in the art upon employment of the invention in practice.

A preferred embodiment of the invention has been chosen for the purpose of component optional configuration illustration and description, and is shown in the accompanying drawings, forming part of the specification.

BRIEF DESCIPTION OF DRAWINGS

In the drawings, closely related figures have the same number but different suffixes.

FIG. 1 illustrates a front elevational view of a primarily sheet-like display device 3000 exhibiting a centrally located "Lite" insignia, and having the right hand forward facing portion of that insignia, broken away to reveal the layered composition of the internal elements making up the chemiluminescent component of the device.

FIG. 2 an unbroken front elevational view of device 3000.

FIG. 3 illustrates an isometric view of device 3000 after its extreme ends have been interlocked to form a visor-like article of manufacture, and shown in the position intended to be worn by a person.

FIG. 4 an end elevational view of device 3000 showing the small portion of permeating light 10 in relation to the rear shell 22 and the remaining portion of extended flange 35

Figure 7:
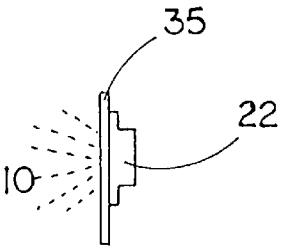

FIG. 7 an end elevational view of device 4000 showing the small portion of permeating light 10 in relation to the rear shell 22 and the remaining portion of extended flange 35.

Figure 8:
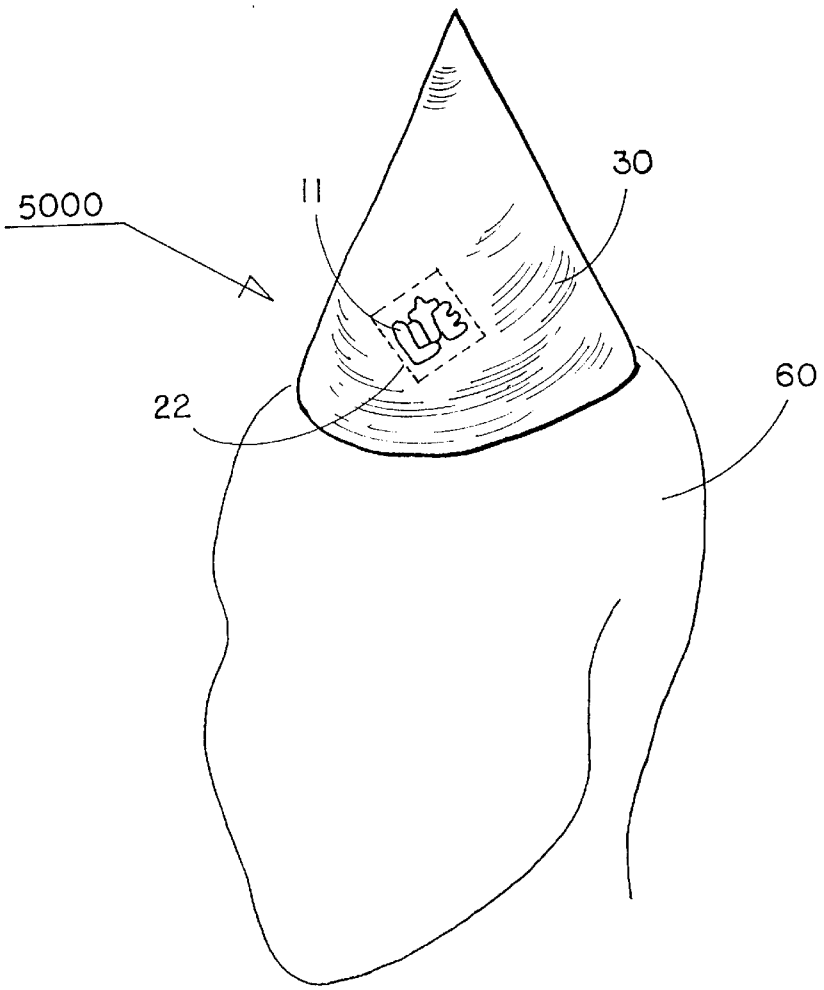

FIG. 8 illustrates an isometric view of device 5000 after it has been assembled to form a party hat-like article of manufacture, and shown in the position intended to be worn by a person.

Figure 9:
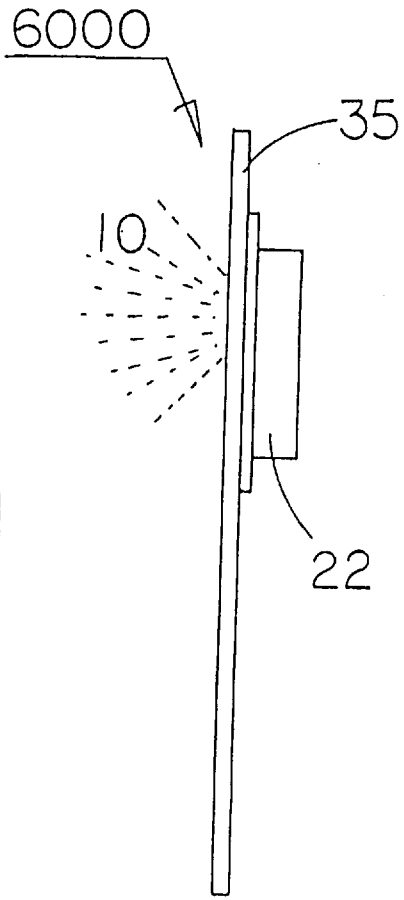

FIG. 9 an end elevational view of device 6000 showing the small portion of permeating light 10 in relation to the rear shell 22 and the remaining portion of the extended flange 35.

Figure 10:
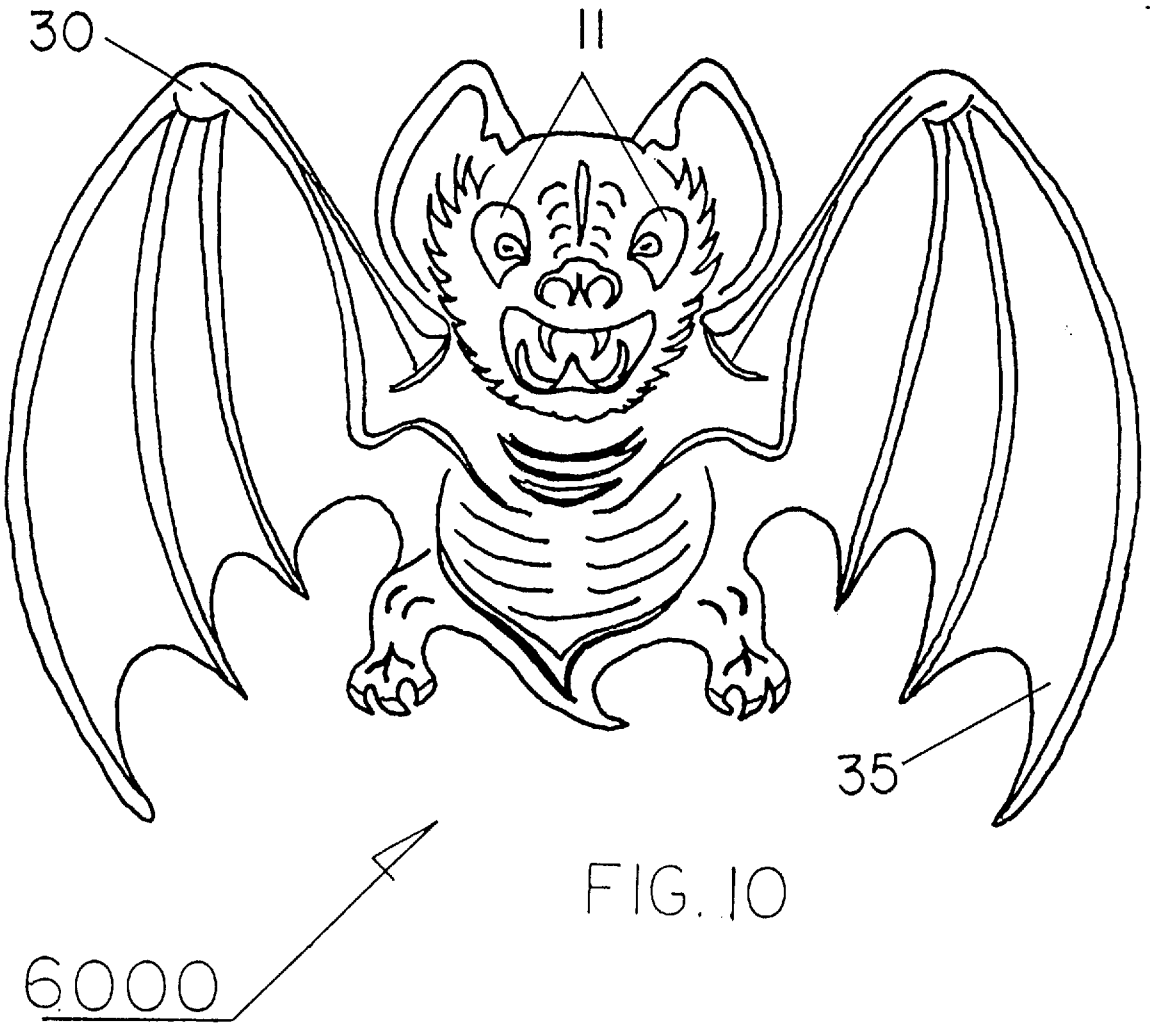

Fig. 10 illustrates a front elevational view of device 6000 where an external display 30 has been imparted on the forward facing surface of the extended flange 35 which in this case demonstrates a peripheral contour of a "Bat" image.

Figure 11:
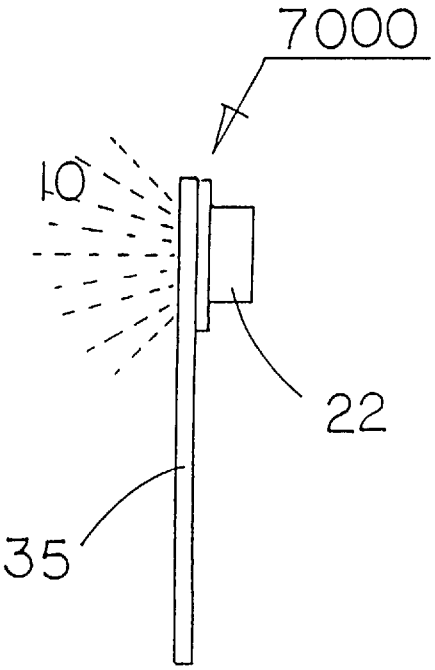

FIG. 11 an end elevational view of device 7000 showing the small portion of permeating light 10 in relation to the rear shell 22 and the remaining portion of the extended flange 35.

Figure 12:
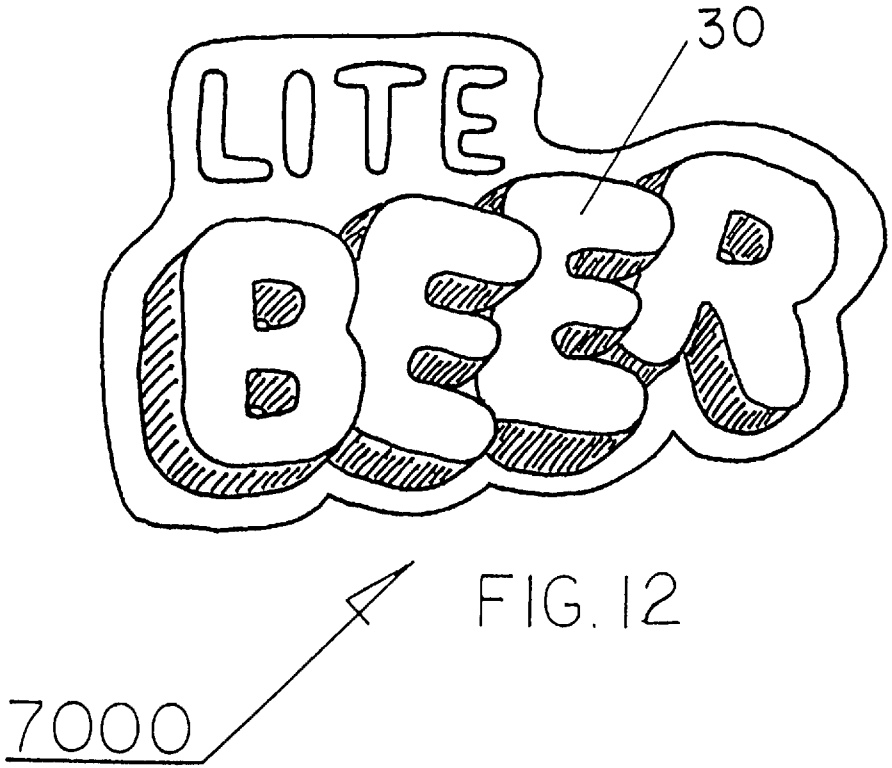

FIG. 12 illustrates a front elevational view of device 7000 where an external display 30 has been imparted on the forward facing surface of the extended flange 35 which in this case demonstrates a peripheral contour of a "Lite Beer" sign.

FIG. 13A shows a front elevational view having its extended flange 5 modified to produce a circular attachment orifice/receptacle 50 on the edge of one side.

FIG 13B shows an end elevational view of the same device in 13A where the open end of the attachment receptacle is viewed.

FIG. 14 illustrates yet another embodiment where several circular devices share common or merged extended flange 35.

Figure 15A:
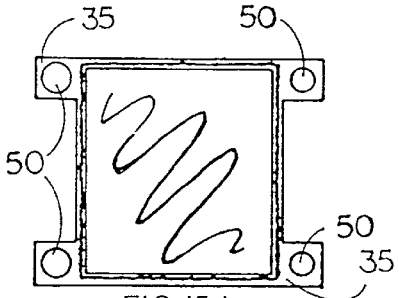

FIG. 15A a square device has two opposing sides incorporating extended flange 35 where each incorporates two attachment orifice/receptacle 50.

Figure 15B:
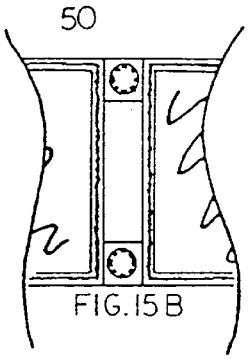

FIG. 15B shows two devices connected.

Figure 16A:
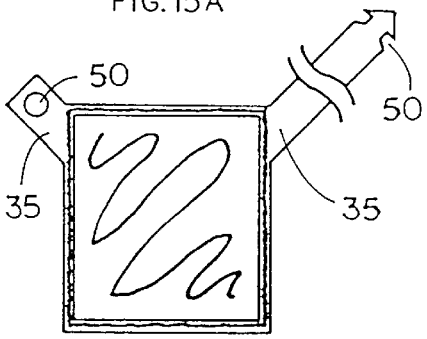
Figure 16B:
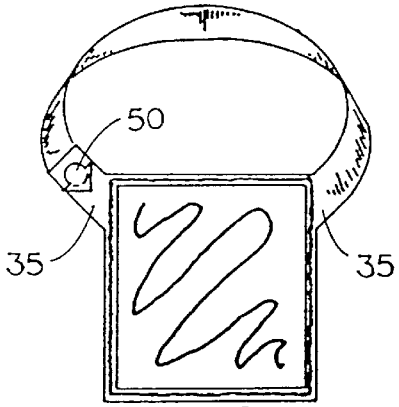

FIG. 16A a square device has two opposing sides incorporating extended flange 35 projecting from two opposing corners at 45 degrees each incorporating an attachment orifice/receptacle 50 at its furthest end. FIG. 16B shows the device of 16A having its extended flange 35 interlocked at the attachment orifice 50, to form a band for supporting/exhibition purposes.

Figure 17A:
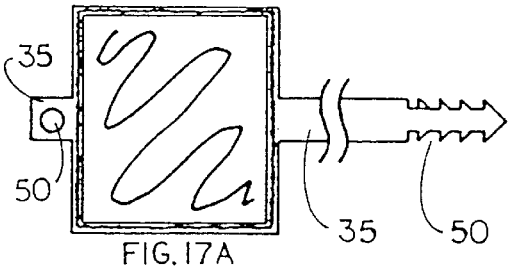
Figure 17B:
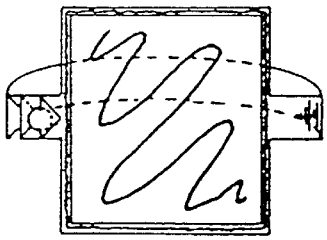

FIG. 17A a square device has two opposing side incorporating extended flange 35 projecting from the center of two opposing sides each incorporating an attachment orifice/receptacle 50 at its furthest end FIG. 17B shows the device of 17A having its extended flange 35 interlocked at the attachment orifice/receptacle 50 to form a band for supporting/exhibition purposes.

Figure 18A:
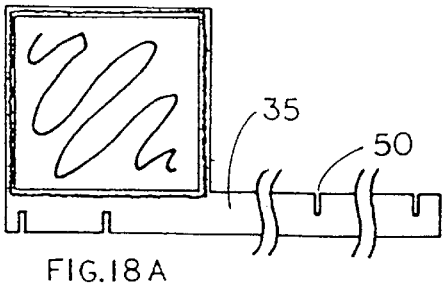
Figure 18B:
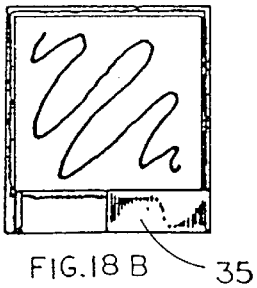

FIG. 18A a square device has one side incorporating an extended flange 35 which aside from projecting perpendicular to that sides impervious seal 32 but also projects sideways at its right side for a distance and incorporating at either of those ends attachment orifice/receptacle 50. FIG. 18B shows the device of 18A having its extended flange 35 interlocked to form a base for supporting/exhibition purposes.

Figure 18C:
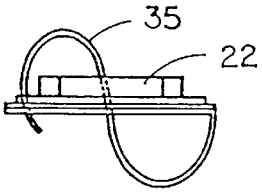

FIG. 18C is a top view of the device having its extended flange 35 interlocked.

DETAILED DESCRIPTION OF DRAWINGS

The following FIGS. 1–4 illustrates a preferred embodiment of the present invention. The reference numeral 3000 generally designates the improved display device. The device 3000 is illustrated by way of example as being primarily a rectangular chemiluminescent liquid lighted device projecting an independent and centrally located "Lite" insignia. Device 3000 further demonstrates its useful application of its extended flange beyond the impervious seal mating the front shell to the rear shell, thus providing a substrate or structural area which, when folded upon itself, and interlocked by accommodations located at either of its extreme ends, produces a visor-like article of manufacture independent of the original chemiluminescent liquid lighted device. Furthermore, device 3000 demonstrates the multiple advantages in extending the flange area of a device containing chemiluminescent liquid, which until now, the flange of prior-art has been disregarded for any significant function other than to incorporate the seal. The unique use of the flange in the design techniques of device 3000 has created an article of manufacture which now has at least three distinct functions. The first function is of course a display of chemiluminescent light, the second function is now an article for wearing or having intrinsic support mechanisms, and the third function provides an additional surface which is commercially useful for decorative secondary display in advertising images or logo's.

FIGS. 5–12 demonstrate other embodiments shown as devices 4000, 5000, 6000 and 7000, where they may have the flange extended on one or more side or portions thereof, and those extended portions may incorporate attachment orifice or structures, along with decorative patterns imparted thereon, and may even be free standing or form part of a multiplicity of chemiluminescent devices. A further consideration is the intended option of suspending such devices by helium filled balloons, due to their lightweight construction. In order to facilitate this form of support, light gauge materials are used, such as for example, thermoplastic type sheet in singular or composite form, of a general thickness 25 mil (0,025 inch) or below depending on requirement for that particular article of manufacture.

FIGS. 13–18 demonstrate typical variations possible when taking advantage of the technique of optimizing the flange area for more than just an area to apply the seal.

Figure 1:
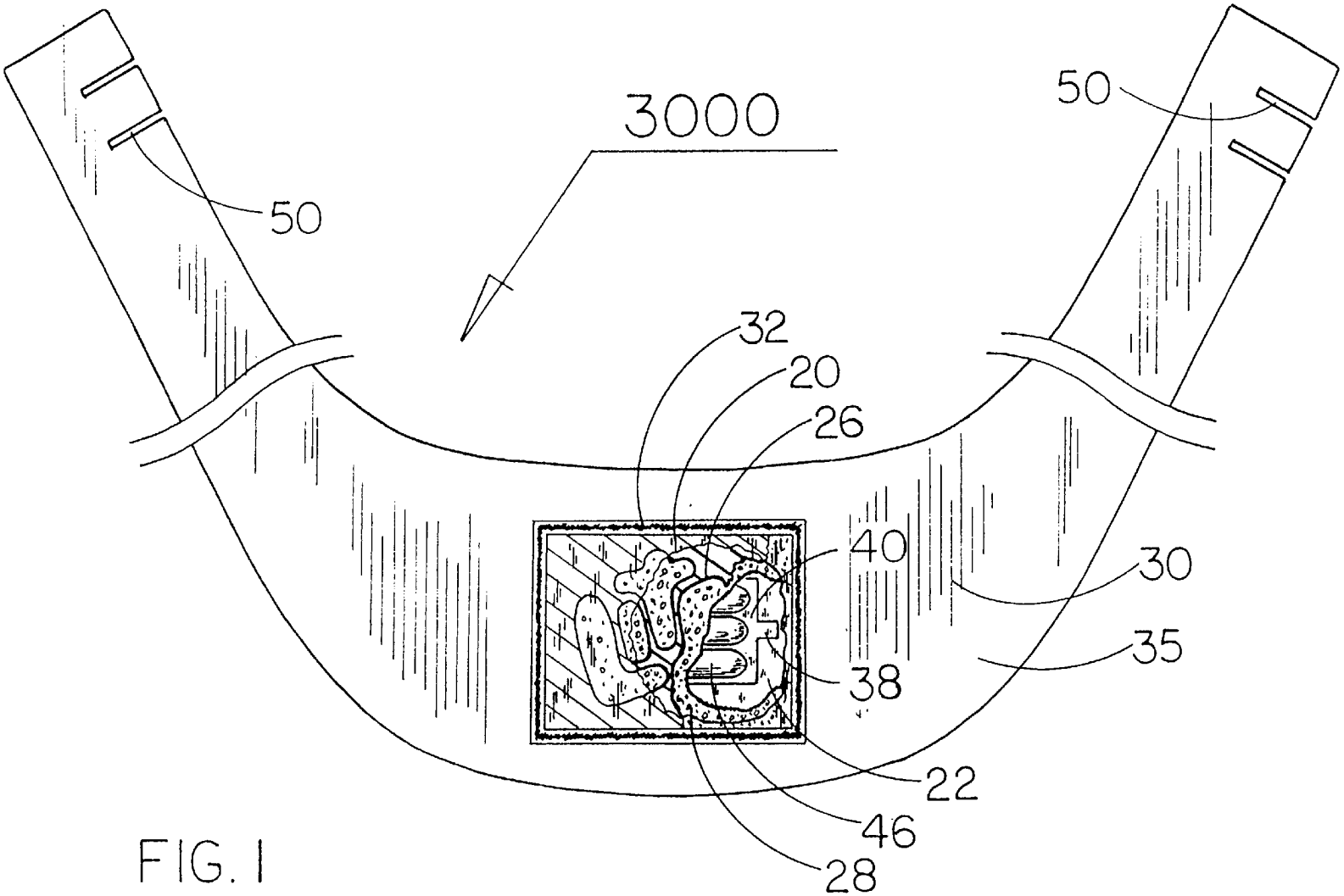

FIG. 1 showing a front elevational view of device 3000 having a somewhat sheet-like configuration and having a centrally located rectangular shape front shell 20 or wall which is partially broken away at its right-hand side to first expose a colored and transparent layer of material referred to as an insert 26 whose perimeter in this case, is rectangular and incorporates within its central area a cutout formed to depict the word "Lite" as a chemiluminescent lighted insignia/accent 11. The insert 26 is also broken away at its right-hand side to expose another rectangular layered component in the form of a light enhancing absorbent material 28. The light enhancing absorbent material 28 is also broken away in a portion of its right-hand side to reveal a set of glass vials 46, seen intact and therefore, the device 3000 is considered to be in a "pre-activated" state, whereby the required portions and ratio of chemiluminescent chemical are still captured and isolated within said glass vials 46. Also exposed is a portion of an opaque rear shell 22 or wall, which within itself is rearwardly recessed, to mirror and accommodate the protruding profiles of the internal components. One such recess is shown as a vial chamber 40, serving as a closely confining compartment to accept said glass vials 46. Radiating away from said vial chamber 40, is another rearward recess which is referred to as a duct 38, primarily designed to convey the chemical away from the vial chamber 40. The flange 34 of said rear shell 22 is imperviously sealed 32 to said front shell 20, and in this case, said front shell 20 demonstrates an extended flange 35 seen further extending laterally and outwardly from the periphery of said front shell 20 and incorporates at either extreme end an attachment orifice 50. The forward surface of said extended flange 35 is shaded to represent the areas available for imparting an external display image 30.

Figure 2:
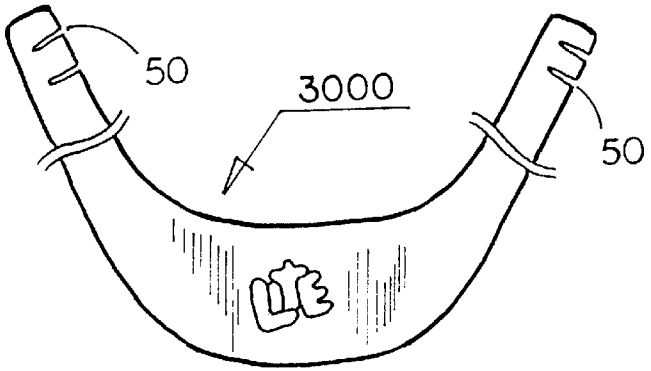

FIG. 2 an unbroken front elevational view of device 3000 which at this point is shown in a state ready for use awaiting activation and assembly for wearing. Its centrally located chemiluminescent lighted insignia/accent 11 shows the dotted lines which trace the outer boundaries of the rear shell 22.

Figure 3:
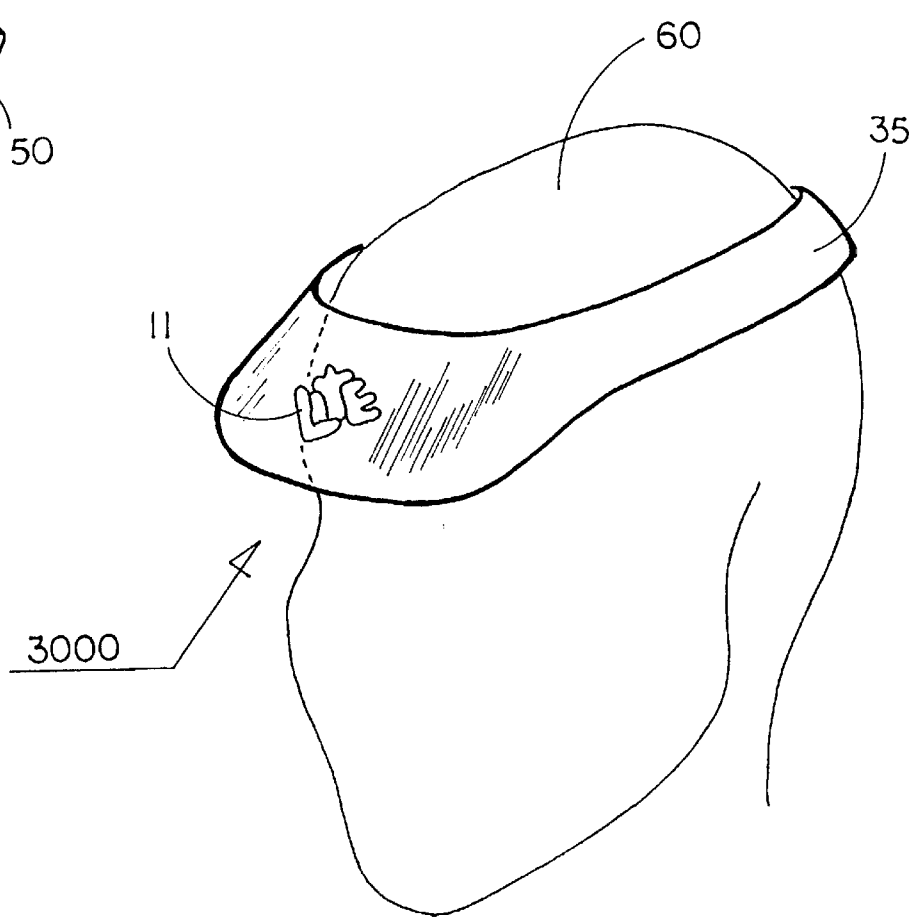

FIG. 3 an isometric elevational front view of device 3000 showing the device as it would appear in an assembled state after its extreme ends have been folded over to meet and interlock with one another at the attachment orifice or receptacle 50. The resulting device is a visor-like article of manufacture that shows it to be suited not only for supporting and displaying the chemiluminescent lighted insignia/accent 11, but also as a useful article for wearing by a person 60.

Figure 4:
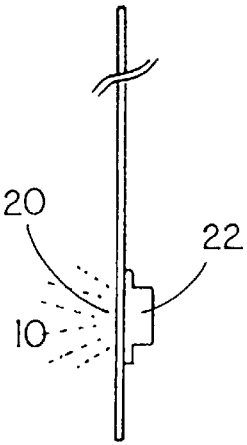

FIG. 4 a side elevational view of device 3000 depicting the position and size of the rear shell 22 in relation to that of the extended flange 35. The dotted lines shown in the area of the front shell 20 represents the direction of the permeating light 10 provided by the chemiluminescent liquid housed within the sealed confines of said front shell 20 and rear shell 22.

Figure 5:
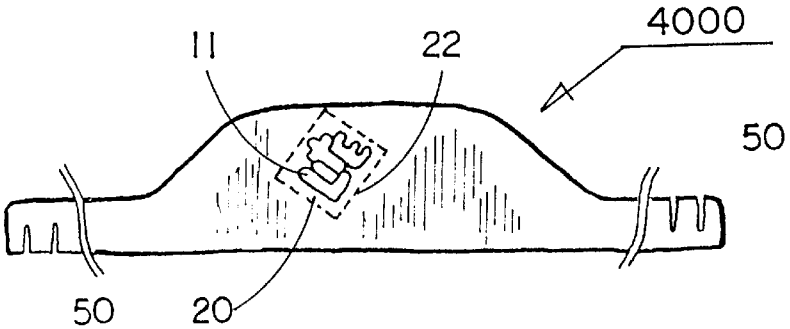
FIG. 5 illustrates a front elevational view of a primarily sheet-like display device 4000 exhibiting a centrally located "Lite" insignia.

FIG. 5 shows another embodiment as device 4000 which utilizes the same principles of the preferred embodiment but with a variation in the shaped periphery of the extended flange 35. The chemiluminescent lighted insignia 11 remains the same, thus showing the versatility of the extended flange 35 in this case shaped in a crown-like shape. The dotted lines trace the boundaries of the rear shell 22.

Figure 6:
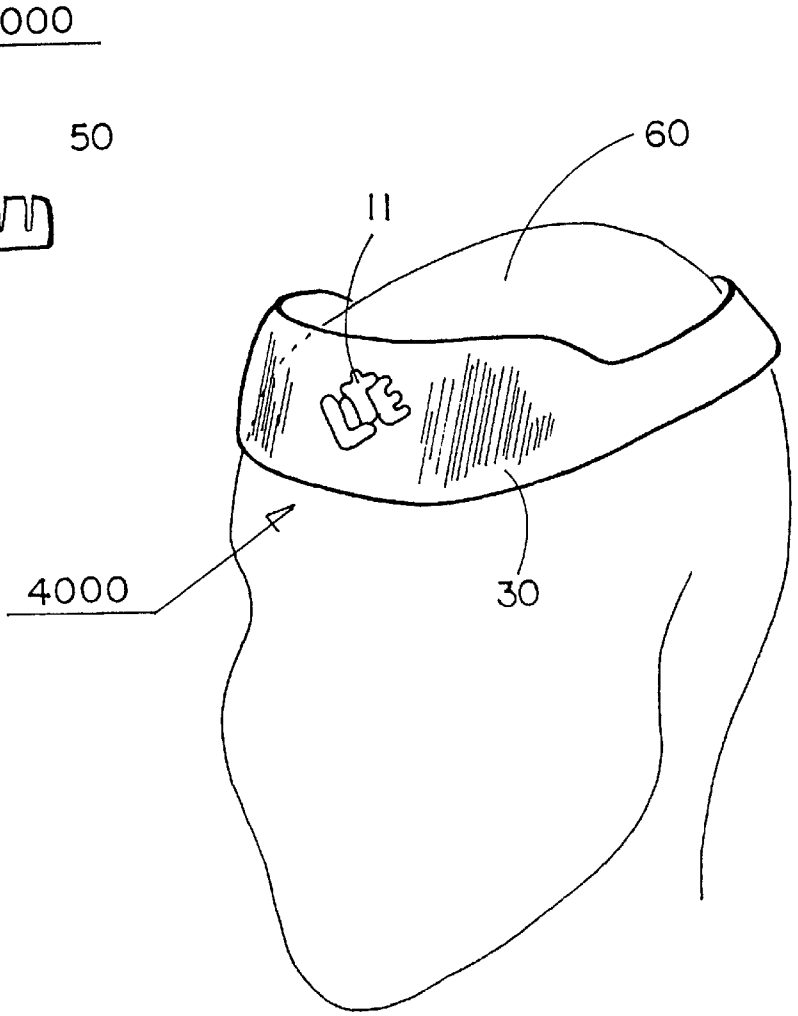
FIG. 6 illustrates an isometric view of device 4000 after is extreme ends have been interlocked to form a crown-like article of manufacture, and shown in the position intended to be worn by a person.

FIG. 6 an isometric front elevational view of device 4000 assembled in a similar fashion to that of the preferred embodiment resulting a different article of manufacture that may also be worn by a person 60 in a crown-like fashion. Showing that the extended flange 35 affords the placement and wearing of the device, which in other embodiments may just as easily take the form of favorite cartoon character or logo.

FIG. 7 a side elevation view of device 4000 depicting the position and size of the rear shell 22 in relation to that of the extended flange 35. The dotted lines shown in this area of the front shell 20, represents the direction of the permeating light 10 provided by the chemiluminescent light house within the sealed confines of the front shell 20 and rear shell 22

FIG. 8 shows another embodiment as device 5000, which utilizes the same principles as the preferred embodiment but with a variation in the shaped periphery, with in this case, once folded upon itself and interlocked produces a party-hat type object for wearing by a person 60. The dotted lines trace the outer boundaries of the rear shell 22, and the shaded area represent the application of an external image 30.

FIG. 9 shows the end elevation of another embodiment as device 6000, which utilizes similar components as in the preferred embodiment and shows the extended flange 35 and its relationship with the rear shell 22. The dotted lines depict the direction and area of the permeating light 10.

FIG. 10 shows a front elevation view of device 6000, which again utilizes the principles of the preferred embodiment but in this case the chemiluminescent lighted insignia/accent 11 may be the eyes. The extended flange 35 has a contour which is in the shape of a "bat" and shows a detailed external image 30 imparted on the forward facing surface of said extended flange 35. elevational front view of device 2000 showing the device as it would appear in an activated state with the aid of dots and hatch lines representing the visual variation in light resulting from each components intended influence over others and over the originating chemiluminescent light.

FIG. 11 shows a end elevational of another embodiment as device 7000, which utilizes similar components as in the preferred embodiment and shows the extended flange 35 and its relationship with the rear shell 22, noting that the extended area is only on one side. The dotted lines depict the direction and area of the permeating light 10.

FIG. 12 shows a front elevational view of device 7000, which again utilizes the principles of the preferred embodiment but in this case the chemiluminescent lighted insignia/ accent 11 may again be the word "Lite". The extended flange 35 has a contour which outlines the external image 30 here shown as the word "BEER" and more importantly is only extended in the lower portion of the device.

Fig. 13 an arbitrary square device similar in the basic principles of the preferred embodiment, however in FIG. 13A a front elevational view shows the extended flange 35 protruding from only a small portion of one side, and in FIG 13B an end elevational view shows that the extended flange 35 exists on both the front shell 20 and the rear shell 20 and they are formed in such a way as to produce a attachment orifice/receptacle 50 which is suitable for inserting a rod or stand.

FIG. 14 an arbitrary set of identical round devices similar in the basic principles of the preferred embodiment, however this front elevational view shows the extended flange 35 to remain common and uninterrupted between each device. The dotted lines trace the outer shape of each individual rear shell 22 having each its own impervious seal 32.

FIG. 15 another arbitrary square device, however in FIG. 15A a front elevational view shows the extended flange 35 protruding perpendicularly and at right angles at each end on two opposing sides, where one side incorporates a formed attachment orifice/receptacle 50 as a male and the other side having the female. FIG. 15B is a partial front elevational view which shows like devices interlocked by mating the male and female attachment orifice/receptacle 50 awaiting possible modular assembly of letter displays or the like.

FIG. 16 again an arbitrary square device, however FIG. 16A a front elevational view shows the extended flange 35 protruding perpendicularly at a diagonal angle on two opposing sides, each incorporating an attachment orifice/receptacle 50 formed at the extreme end of its extended flange 35. FIG. 16B shows the same device as in FIG. 16A having its extended flanges 35 folded upon themselves an interlocked at their respective mating attachment orifice/receptacle 50 awaiting possible use as a necklace style display.

FIG. 17 another arbitrary square device, however in FIG. 17A a front elevational view shows the extended flange 35 protruding perpendicularly at right angles from the center portion of two opposing sides each having an attachment orifice/receptacle 50 formed at its extreme end. FIG. 17B shows the device folded and interlocked for use possibly as a waste band or arm band.

FIG. 18 another arbitrary square device, however in FIG. 18A a front elevational view shows the extended flange 35 protruding perpendicularly at right angles on only one side and where one end is elongated beyond the adjacent side and incorporates attachment orifice/receptacle 50 on either end and at its center. FIG. 18B shows the device folded and interlocked for use possibly as a free standing display.

Further description of the Preferred Embodiments of the invention, including their significant operation This invention is directed at a device for the control and display of chemiluminescent light, of which is described a basic device comprising in sequential relationship.

a) Said front shell 20 is formed as a wall or sheet-like layer of a thermoplastic resin, where its central area plays host to the layered internal components confined between its rearward facing surface and a rectangular shaped rear shell 22 that is imperviously sealed 32 thereon creating a chemiluminescent lighted display device. The remaining portions beyond that area constitutes the extended flange 35 component of said front shell 20 and is considered to be the principle object of device 3000. The main advantage of this extended flange 35 is that it provides a surface through which orifices or receptacles may be formed in order to facilitate attachment, merging and interlocking methods such as string, cords, pins, nails, buckles, slots. . . etc. The extensively flat structure of this wall is significant in the case of device 3000, because it is shaped in such a manner that when folded upon itself and interlocked, it converts from merely a chemiluminescent lighted display to an article for wearing by a person. Furthermore the additional surface area now available through this extended flange 35 surface provides a substrate to create yet another opportunity for additional non-lighted display which is common and possibly complimentary to the lighted display within its central portion. In other embodiments the extended flange 35 may exist on one or more sides and may even protrude from multiple portions of the sides, and have molded accommodations or formations thereon, and may not only be used for wearing by a person, but also hung from balloons, attached over or around foreign objects, become a stand or rest for foreign objects and become mingled or interconnected with foreign objects or like devices. Said extended flange 35 in other embodiments is the primary component for converting a singular chemiluminescent lighted display into another functional device or display independent of the lighted display yet being a common component to both.

b) Other components such as insert 26 which may be a thermoplastic resin or even an opaque air-laid cellulose material and light enhancing absorbent material 28 which may be a acrylic or cellulose material, are liquid light control layers which are utilized in a layered fashion to project and/or enhance the lighted image which in the case of device 3000 is the word "Lite". Both these components are strategically located and controlled much like the glass vials 46 which contain and isolate each proportionate part of the two part chemiluminescent system prior to activation by crushing are confined in the accommodations provided by the thermoplastic resin rear shell 22. These accommodations for said glass vials 46 are primarily, the vial chambers 40 and ducts 38 each of which are rearward recesses formed within the forward facing surface of said rear shell 22 wall and which control and promote the distribution, and activation of the chemiluminescent liquid. Said rear shell 22 completes the display device upon being imperviously sealed 32 along its flange 34 to the rearward side of said front shell 20.

In other embodiments these components may be manipulated and positioned to achieve any required display, for example the display may be another word like "BEER" or even take on the appearance of glowing eyes with each display the necessary shapes and contours may be utilized to the best advantage. Furthermore, it may even be possible that a plurality of independent rear shell 22 be sealed to an unbroken said front shell 20.

Considering the instant invention whose major components are presented above within said device 3000, and recognizing that this is a display system whose varying combination of internal layered components are manipulated to control the chemiluminescent light for desired effect, and by creating mirrored recesses within the device itself for those internal components, in order that they interact in a controlled and somewhat predictable manner, result in a superior chemiluminescent light display.

The instant inventions, display system overcomes not only the pitfalls of previous single recess or vast cavity designs, which are inferior in overall activation performance but also the instant invention demonstrates unlimited diversity in display and function, where the device is not only capable of being a superior lighted display but among other things is a strong non-lighted display and moreover, lends itself to being automatically and intrinsically converted into other functions independent of visual display. Therefore prior chemiluminescent lighted devices were lacking in the ability to truly be a diversified article of manufacture that provides a commercially attractive device transcending the field of advertising and novelty products alike.

The added value of the instant inventions superior technique, is that the inherent benefit of these techniques allow the manufacture of larger devices, which again are of greater appeal to the commercial field of advertising.

In order to avoid repetition and for purposes of abbreviation the term "chemically compatible" herein after is to be comprehended as, and brought to bear, that all components are reasonably compatible with one another, in so far as, during their required operation such components be resistant to unreasonable degradation by the chemiluminescent chemical without unfavorably affecting the chemicals required performance.

Further noting that the favored chemiluminescent material is a liquid capable of providing chemiluminescent light for a finite period. The precise chemical or physical nature of the chemiluminescent composition is not critical to the definition and scope of this invention. However, the light which is emitted by the material is preferred to be in the visible range and the material itself be "chemically compatible" within reason with materials utilized in the present invention.

Similarly the favored materials used in the creation of the present invention are materials which are capable of performing their desired function adequately so that they may interact favorably with one another to produce an illuminated display.

The precise method of chemical isolation used is not critical to the definition and scope of this invention. However, the method used is preferred to be "chemically compatible" within reason with the chemiluminescent chemical, and that the materials used are capable of performing the desired task of containment and isolation until desired that the contained chemical be readily released for mixing.

The precise chemical or physical nature of the materials used are not critical to the definition and scope of this invention. However, the material used is preferred to be "chemically compatible" within reason with the chemiluminescent chemical, and that the materials are capable of performing the desired task set forth by this inventions characteristics as a display system of interacting recesses, compartments, cavities, or the subordinates thereof, layers and formed surfaces or vessels.

Regarding said front shell 20 and said rear shell 22 both are "chemically compatible" within device 3000 (FIG. 1) being transparent to translucent and opaque respectively, and typically of a thermoplastic resin sheet whose thickness range will generally not exceed 25 mils (0.025 inch) and may be produced from a polyolefin such as but not limited to, polyethylene, rigid vinyl, or the like.

In other embodiments said rear shell 22 for example may be formed of materials of a composite nature, such as a composite sheet having an outer layer of a metallic foil permanently joined by laminating on its underside or inner facing layer to a flexible thermoplastic resin or polyolefin type layer. Then being formed into a side or shell by a compression method producing an opaque shell of a single sided viewed device. Not only will this shell possess all of the attributes of a thermoformed shell which is capable of being formed into shape and sealed to its opposing shell, but also exhibits an added internal component restricting benefit, which is that when this composite type shell which is sealed to an opposing transparent shell, is then depressed in the said vial chamber 40 (FIG. 1) areas, in order to crush said glass vials 46 for activation, these areas will remain depressed in those areas due to the nature of the memory retaining metallic foil layer. The advantageous result of this performance is that the void normally left behind once the said glass vials 46 disintegrate, is now removed and therefore provides added rearward support to the other internal components still remaining.

The foremost consideration for the selection of shell material, is that the material is capable of being formed into its required shape and able to withstand the intended operational forces without violating the devices integrity as a liquid container, yet remain "chemically compatible".

Forming of said front shell 20 or said rear shell 22 in the case of device 3000 may be achieved through die cutting a raw material sheet once desired features have been thermoformed thereon, but may also be achieved in other embodiments by pressure forming methods such as compression molding, or even injection molding.

Regarding said rear shell 22 in the case of device 3000 having thermoformed therein multiple recesses, compartments, cavities or receptacle-like features, which once sealed together with said front shell 20, produce a housing with five (5) critical criteria contributing to device performance, and essential for the successful control of internal components and a major influence in the performance of said device 3000, thereby making possible greater diversity of shape, dimension, activation, and arrangement. The five (5) criteria are as follows:

i) Provide a shell utilizing minimal inner cavity design, by defining a first rearward recess or main compartment for confining layered components, then incorporating further rearward recesses as subordinates to the first for confining and controlling the chemical itself and its isolating receptacles. These rearward recesses essentially mirror the profiles or displacement of the internally housed components, and have an aggregate void dimension which is without excessive volume in relation to the housed internal components. Resulting in effect to sandwich internal components between either shells inner surfaces and keeping in check those internal components for presentation as an artistic display.

ii) Provide a shell utilizing a specific recess or compartment, for the location and restraint of layered internal materials. Thereby providing simultaneous forward and rearward support for those layered material configurations.

iii) Provide a shell utilizing specifically located subordinate recesses or compartments, as consolidating type receptacles for the location of chemical isolating devices. Resulting in a confined area for these devices to be violated or destructed in order to release their contents to become relatively instantaneously mixed, initially in these confines and then dispersed to become absorbed. Thereby achieving controlled points of release for even and predictable absorption for superior activation and operation.

iv) Provide a shell utilizing specifically located and directional subordinate recesses or compartments, intersecting or interconnecting other larger compartments and radiating toward the inner boundaries of the device flange. Resulting in a conveyance feature for assisting the transfer of released chemical from within those larger compartments and toward the extremities of that particular device.

v) Provide a shell utilizing an area extending beyond the sealed perimeter of the device, without interrupting the integrity of that seal, which provides a foundation for the merging and interconnecting of that particular device with other devices, or provide a substrate for support and suspension, thereby achieving a protruding surface which may become common by bonding, tying, adhering, forming, extruding, pinning, or any other method to achieve this end. Furthermore the use of this area for display support or exhibition now liberates the second side of the device only then is it possible to have the option of producing a truly functional double sided display.

In explanation and matching of Device 3000 component features to the five (5) listed critical criteria available for the design of Device 3000 is as follows:

Criteria i, ii, iii & iv are evident in device 3000 where all internal components a shown to be controllably located and confined within their intended areas which meet the specific functions and performance as outlined above.

Criteria v is evident in device 3000 where said extended flange 35 (FIG. 1) is a protruding feature generally extending laterally outward from the periphery said impervious seal 32. Most importantly said extended flange 35 is provided as a medium which may accept an orifice or other integral form to become common, merge or interlock with itself or in other embodiments, another device or method of suspension or support. These methods of accommodating attachment may be achieved by extruding, bonding, sealing, forming, tying, pinning or any other method which will cause the mingling of devices upon any portion of said extended flange 35. The added surface area created may now be used for nonlighted displays imparted thereon as an added benefit.

Regarding said inserts 26 (FIG. 1) being "chemically compatible" within Device 3000 formed of a transparent thermoplastic resin layer having die cut or knocked out from its center area the word "Lite" and seen as the layer immediately behind said front shell 20 and directly in front of said light enhancing absorbent material 28. This component is a light controlling member of different color to that of the chemiluminescent chemical light, effectively altering the visual color of the originating light over which it is superimposed and not affecting the color of the light passing unaffected through its knocked out center area. The result is a two color visual effect. Also said insert 26 is relying on its position between the aforementioned components for its support and effective presentation.

However in other embodiment said inserts 26 may be of any "chemically compatible" material, layered singularly or in plurality, positioned in front of, attached to, imparted on or incorporated in, any light enhancing material utilized to create the desired visual effect of light contracts. Said inserts 26 also having two (2) critical criteria governing their performance for successful control of light. The two (2) critical criteria are as follows:

i) Provide a light "altering" material allowing the passage of originating light directly under its influence to appear altered in visual color and shade upon passage thereof and therefore appear altered or different to other unaffected areas.

ii) Provide a light "contrasting" material by engulfing or blocking the originating light within itself or behind itself to thereby appear indiscernible from its originating state and therefore of a stark contrast to other unaffected areas.

In explanation and matching of these critical criteria to that insert 26 used in device 3000 as follows:

Criteria i is evident in Device 3000 where insert 26 (FIG. 1) is a layer of material similar to that of said front shell 20 however is of a color opposite or different to the originating light and therefore will achieve a light altering influence over that light passing through it. In other embodiments this light altering effect may also be achieved by a layer of inert dye directly over or in contact with any area of the absorbent material.

Criteria ii) is not utilized in device 3000, however for the purpose of explanation, if in another embodiment the insert material were to be formed of a porous absorbent material having within itself or imparted upon itself a dark and non-reflecting color, the resulting effect would be to suppress, negate or block that light directly under its influence in-turn creating a stark contrasting effect to that of other unaffected areas.

Regarding said light enhancing absorbent material 28 (FIG. 1) being "chemically compatible" within device 3000, being a porous liquid-absorbing material of a light enhancing characteristic due to the ability of its mass to readily reflect the absorbed lighted chemical. Said light enhancing absorbent material 28 is seen as a layered material immediately behind said inserts 26 and directly in front of, in some areas said glass vials 46 and the remaining area said rear shell 22. This component is a porous absorbent material readily saturated by the chemiluminescent chemical isolated within said glass vials 46 and this material is one such as a virgin non-woven material being 100% acrylic felt, available from "the Felters Co" of MA and generally of a thickness 0.18 inch or below. However in other embodiments other unique design porous absorbent materials such as composites like a high-loft, nonwoven/air laid cellulose sheet available from "Oliver Products" of Mich., or even other porous absorbent such as pulp or fiber paper sheet with blotting capability available from "James River Corp" of Pa.

Furthermore referring to materials listed in U.S. Pat. No. 4,814,949 to Elliott, under table 1, which portrays limitations for what Elliott considers an ideal material within the teachings and specifications of Elliotts device. Contrarily, a majority of those materials listed by Elliott as other may be successfully employed within the instant invention due to the five (5) critical criteria used in the shell design, furthermore the instant invention may utilize each materials unique characteristic to its advantage, because the instant invention has the necessary features to overcome or compensate for any material weak point unlike Elliott, and so can benefit from the strong point of the material if that characteristic is so desired to achieve the required artistic display.

Therefore, device 3000 or any other embodiment of the present invention requires that the porous absorbent material reasonably perform to that function for which it was selected, whether it be that high light output, negation, suppression or absorbency of light is the function of choice. Issues of rigidity are of no major concern for the instant invention because the device shell provides the support.

Unlike the limitations for absorbent selection set in the table provided by Elliott just to overcome collapse while providing suitable light emitting properties before an acceptable device may be produced, hence, Elliott is admitting to limited application and therefore can not be considered or compared to the instant invention as a system for light control and artistic display.

Regarding said glass vials 46 (FIG. 1) formed of a frangible glass tube, heat sealed at both ends, preferably of type N51A glass available from "Becton Dickinson" of Mont. The function of said glass vials 46 within said device 3000, is to contain and isolate therein one opposite part of the two part chemiluminescent chemical system until required for activation. It is to be noted that in the case of said device 3000 the selected chemical proportion is 2:1 and therefore, one said glass vial 46 is accompanied by two similar said glass vial 46 containing the opposite proportionate part of the chemiluminescent compound thereby completing the chemiluminescent system required to produce the chemiluminescent light. Said glass vials 46 are themselves in the case of said device 3000 contained in specific areas of said rear shell 22 (FIG. 1).

Said glass vial 46 must generally be of the frangible range whereby, crushing by hand may occur by exerting a reasonable pressure upon the external surface of said vial chambers 40 bearing down on and deflecting said glass vials 46 surface, in so doing disintegrating those proportionate groups of said glass vials 46 within said vial chambers 40 and releasing their contents to become combined with those released from their abutting similar said glass vials 46 containing the opposite chemical part. Relatively instantaneous mixing initially occurs in the area of said vial chambers 40 yet further mixing and dispersion occurs as the released chemical travels within said ducts 38 becoming deposited in numerous remote areas across the surface of said light enhancing absorbent material 28, the total quantity of chemical is such that substantial saturation of absorbent material within device 3000 occurs.

However in other embodiments, other frangible materials or methods of chemical containment and isolation may be adapted and employed such as for example the fragile glass capsule within a flexible container as disclosed in U.S. Pat. No. 2,681,168 or any other effective method of containment for that matter.

The precise method of chemical containment and isolation is not critical to the scope of the instant invention, as long as effective containment, isolation and release are achieved, this is all that is require for the instant invention to then control the points of release and dispersion during such an event, by suitably adapted providing locations such as said vail chambers 40 and said ducts 38, which in turn ensure a superior dispersion and distribution of activated chemiluminescent chemical.

Regarding device 4000, 5000, 6000 & 7000 (FIG. 5. . .11) intended to simplify and convey the concept of design variations made possible utilizing the display combinations of components and features provided by the instant inventions component system. Moreover to present in an imaginative fashion, the light control afforded by the two (2) critical criteria relating to said inserts 26, yet without overlooking the five (5) critical criteria applied to said front shell 20 or rear shell 22, which is the essence for the successful production of effective artistic display devices of this kind. In so doing, illustrating how the instant invention liberates visual and physical dimensional boundaries experienced by other forms of chemiluminescent devices utilizing a vast cavity design, and most importantly demonstrating the diversity and ability of creating articles of manufacture that have a function independent of the lighted display yet being common to the original device. thereby presenting the following examples created as follows:

Example 1

A display device 4000 (FIG. 6) shown in isometric front elevational view shaped as a crown-like article of manufacture once assembled by folding its ends upon themselves and interlocked, intended not only to have the word "Lite" projected by its intrinsic light produced by the incorporated chemiluminescent liquid lighted display device located in that area, but also to provide in the areas of the shaded lines, an opportunity for non-lighted display.

Front shell (FIG. 5) may be formed from a sheet of colorless yet transparent thermoplastic resin about 0,02'thick, which therefore will not influence the color of the light in any way but will allow the light to pass through easily. The perimeter flange area of the rear shell is sealed to the rearward side of that front shell. Once imperviously sealed together the two create a device package or compartment suitable to control the position of the internal components. Furthermore, the front shell shows extended flange areas (FIG. 5) with incorporate attachment accommodations at either end in the form of mating slots.

Rear shell (FIG. 5) may be formed from a sheet of black and opaque thermoplastic resin about 0,02'thick, which therefore will not allow light to penetrate in this rearward direction. Its flange area will mate in a parallel and flush relationship to the rearward surface of the front shell. Its inner area exhibits all the functional characteristics of the display device inner cavity having a first recess within the boundaries of the flange area, and then in a separate central subordinate area there is a further rearward recesses creating a vial chamber for a set of vials. These compartments contain and confine the internal components. The insert located in one of those compartments is formed of dark blue tinted yet translucent thermoplastic resin sheet about 0.01'thick which is overlaid and fixed into position upon the porous material of the light enhancing absorbent material by a "chemically compatible" method such as an instant or silicone glue available from "Devcon Corp" of Ill. However any fixing, bonding, sealing or taping method may be used as long as it is "chemically compatible". This component will allow the passage of light, however because the blue tinted insert is of a different color to the spectrum of yellow light generated by the chemical released from the glass vials, the light will be altered to appear green as it emanates outwardly from the insert covered area and remain yellow in the area unaffected by the insert which in this case is the letters of the word "Lite".

Light enhancing absorbent material is formed of white light enhancing 100% acrylic felt about 0.05'thick engrossing entire inner cavity profile or first rearward recess in the rear shell Because of its porous nature and light color and therefore reflective mass, it will readily absorb the released chemical and then project that light in an outward direction to be controlled or effected as it passes through the blue tint insert to become visually green in appearance, yet not be affected by the transparent front shell Glass vials each isolate the chemiluminescent component proportions from one another until released by crushing the vials. The chemiluminescent light provided in this case is producing yellow light. The complete and proportionate set of vials are controlled in the compartment within the rear shell so that they may remain in that area awaiting release and mixing, whereupon their strategic location assures instantaneous and even chemical distribution for absorption into the light enhancing absorbent material.

Device 4000 (FIG. 6) is activated by applying pressure externally and directly onto the vial chamber area, which ruptures the glass vials to release the chemiluminescent chemical for mixing to create a yellow light. The chemical dissipates throughout their respective components and features of the device, in so doing presents Device 4000 as a crown-like article of manufacture for wearing by a person with a central area showing a yellow lighted accent as the word "Lite" on a green lighted background and other surrounding areas showing externally applied non-lighted display all functions produced within a single article of manufacture.

Example 2

Device 5000 is conceptually the same as example 1 except for the following changes: The extended flange is shaped in such a manner as to allow when folded upon itself and interlocked the device 5000 to resemble a "Party Hat structure" for wearing by a person.

Example 3

Device 6000 is conceptually the same as example 1 except for the following changes: Insert has cut outs in its central area which replicate Bat eyes, and the material used for the insert in this case is opaque thus blocking light completely for maximum contrast against lighted eyes. The remaining bat image is non-lighted and is imparted directly on the remaining portion of the extended flange which is contoured to outline that image. This device may scattered, propped or hung in any area for desired effect.

Example 4

Device 7000 is conceptually the same as example 3 except for the following changes: Insert used is same as example 1 but is opaque for maximum contrast against light. The remaining BEER image is non-lighted and is imparted directly on the remaining portion of the extended flange which in this case extended only at the lower portion of the chemiluminescent display device. Accordingly the reader will understand that there are unforseen advantages in the component operation in said device 3000 4000, 5000 and 6000 and the instant invention, which instead of just being a chemiluminescent container, it is rather a device whose unique design affords the use of a system of components to achieve a combination illuminated and non-illuminated artistic display.

Aside from the prolific effect in overcoming the potential for collapse of the layered materials, in a chemiluminescent device such as provided by said device 3000 and the instant invention, has produced many options of configuration and display, by providing not only areas within all components to experience simultaneous forward and rearward support, but also demonstrating that the flange area can become extended and not merely accommodate the needed impervious seal but a useful article of manufacture.

Furthermore when considering the manufacturing aspect with relation to costs and material selection, the instant invention has to a considerable extent overcome absorbent collapse, and therefore has created an advantage which allows not only the use of a wider range of absorbent materials, but also thinner materials can now be used in larger displays. Of the many positive effects of being able to use thinner absorbent material, not only is the device lighter because of lower absorbent bulk, but also requires less chemiluminescent chemical to saturate the absorbent area, which further contributes to an even lighter device. But ultimately, lower material and chemical levels with the added advantage of utilizing the flange to form articles of manufacture independent of the lighted display translate to lower and more competitive pricing.

Unfortunately the designs of prior art, neglected to consider the area beyond their seal areas to be useful, this reoccurring oversight resulted in missed opportunity in creating novelty items which are useful and attractive in the lucrative field of advertising.

Another unforseen advantage of an assembly such as said device 3000 and the instant invention, is that once such teachings of device recess and layer design is incorporated into a display, there is an inherent surface tension caused by these components being assembled in this restricted and confined manner that becomes particularly suited to sustaining the deflecting forces, which occur during specialty application device handling such as the application of external images.

A further advantage demonstrated in said device 3000 is the use of the extended areas of said flange 34 to become the foundation for the support and exhibition of the instant invention. The numerous advantages of this said extended flange 35 is that the side that would normally be occupied by adhesive or fixing agents as used by others, may now be optionally used as another display area affording the potential of the device being used as a center piece type display.

Also the instant invention has demonstrated the advantage of a truly novel and imaginative use of this perimeter area which opens new and exciting ways of exhibiting such a device to effectively customize its application, from being part of a larger continuous display, to being part of modular system of snap together numbers and letters, to being a button hole pendant, to being a wrist, waist, neck or head band, to being a stand alone sign, to being a continuous roll of shapes which may be cut to order, to being a coaster, to being inserted in a cardboard cut-out, the list is limited only to the possible shape, orifice, or formation achievable on this said extended flange 35.

Although the description of the instant invention above has demonstrated an effective and creative form of chemiluminescent exhibition containing many specificities, these should not be construed as limiting the scope of the instant invention but as merely providing illustrations of some of the presently preferred embodiments of this invention.

For example, the device may have other shapes, such as open or closed forms, convex or concave forms, trapezoidal, triangular, oval, figurine, etc., it may project light from a single side or both sides, either shell may be opaque composite or laminated materials and omit any number of available features, features may be of any dimension and have semicircular or triangular cross section rather than rectangular or square, images may be imprinted on internal components, internal components may be extended and incorporated in the perimeter said impervious seal 32, inner areas of the said front shell 20 and said rear shell 22 may receive occasional spot welds for added support, interconnecting components may be incorporated or extend from the surface area of said flange 34, total chemical isolation from either side may be achieved by extending and sealing another layer between said flange 34 of either said front shell 20 and said rear shell 22, this layer itself could have formed therein all the features used on said front shell 20 and said rear shell 22 in turn allowing said front shell 20 and rear said shell 22 to be flat in cross section, said glass vials 46 may be replaced by plastic film type containers, chemiluminescent viscosities or compounds may be varied, etc.

Thus the scope of the invention should be determined by the appended claims and their legal equivalents, rather than by the examples given.

I claim:

1. An artistic display deice comprising, in combination:

a shell having a substantially flat front wall through which an optical image is to be transmitted, a rear wall substantially parallel to said front wall, said front wall being larger in size than said rear wall;

said rear wall being secured to said front wall, said front wall includes portions which extend beyond said rear wall and these portions form an extended flange, said front wall and said rear wall each including peripheral edges, said peripheral edges of said rear wall being spaced inward from said front wall peripheral edges;

said rear wall rearwardly recessed to form a compartment;

a body of liquid-absorbing material forming essentially a flat layer positioned between said compartment and said front wall;

a flat light control member disposed between said body of liquid-absorbing material and said front wall of said shell for modifying light that is generated from said liquid-absorbing material and transmitted through said front wall;

at least one set of frangible vials housed in said compartment containing respectively separate liquids, which vials may be broken so as to mix the liquids to provide a chemiluminescent light-generating mixture that will then saturate said body of liquid-absorbing material.

2. An artistic display device in claim 1 wherein said extended flange materializes as a non-lighted sub-structure since said extended flange is isolated from said chemiluminescent light-generating mixture.

3. An artistic display device in claim 2 wherein said non-lighted substructure extends beyond said rear walls peripheral edges to aid in device manipulation.

4. An artistic display device in claim 2 wherein said extended flange provides a base for incorporating elements to aid in configuring said artistic display device into secondary useful objects or displays.

5. An artistic display device in claim 1 wherein said extended flange incorporates elements for intedocking.

6. An artistic display device in claim 5 wherein said elements for interlocking aid in manipulating said extended flange upon itself to present an object for wearing by a person.

7. An artistic display device in claim 1 wherein said extended flange is patterned into recognizable shapes and images.

8. An artistic display device in claim 1 wherein said extended flange may have decorative display images imparted thereon.

9. An artistic display device in claim 1 wherein said extended flange incorporate elements for support thereon.

10. An artistic display device in claim 1 wherein said extended flange incorporate elements for interlocking.

11. An artistic display device comprising, in combination:

a shell having a substantially flat front wall through which an optical image is to be transmitted;

a body of liquid-absorbing material essentially in the shape of a flat layer and disposed parallel to said front wall and having a perimetrical portion that is disposed adjacent said front wall;

a flat light control member disposed between said body of liquid-absorbing material and said front wall of said shell;

said shell further having a rear wall disposed substantially parallel to said front wall, said walls being secured together by an impervious seal, said rear wall also having a perimetrical portion positioned in supporting relationship to said perimetrical portion of said body of liquid-absorbing material;

said rear wall being also rearwardly recessed inside said perimetrical portion to form at least one compartment containing a set of frangible vials having separate chemilurninescent liquids therein; and wherein said front wall is larger in dimension than said rear wall said front wall and said rear wall each including peripheral edges, said front wall having at least one portion protruding outwardly beyond said peripheral edges of said rear wall to provide an extended flange, aid extended flange aide in the manipulation of said device into independent articles for the exhibition of said device.

12. An artistic display device as in claim 11 wherein said extended flange has an outlining contour extending beyond a contour of said impervious seal of said front wall which may be distinct in contour form that of said impervious seal.

13. An artistic display device as in claim 11 wherein said extended flange has an outlining contour distinct from said perimetrical portion of said rear wall.

14. An artistic display device as in claim 11 wherein said extended flange is an integrated substructure which incorporates elements for interlocking therein.

15. In an artistic display device including a shell having a transparent front wall through which an optical image is to be transmitted, a rear wall forming in cooperation with said front wall a compartment, a set of frangible vials in said compartment having separate chemiluminescent liquids therein and which may be broken to mix the liquids and thereby provide a light-generating mixture for generating light, and a body of liquid-absorbing material for retaining said liquid mixture after said vials have been broken; and wherein said front wall is larger in dimension than said rear wall, said rear wall remains spaced within inward boundaries of said front wall, said front wall includes portions which extend beyond said rear wall and these portions form an extended flange, said extended flange for incorporating elements for manipulation, plying and interlocking in order to form useful objects.

16. An artistic display device as in claim 15 wherein said extended flange incorporates elements for manipulation into an object for wearing by a person.

* * * * *